US009581401B2

(12) United States Patent
Faxon

(10) Patent No.: US 9,581,401 B2
(45) Date of Patent: Feb. 28, 2017

(54) FIREARM GRIP SAFETY

(71) Applicant: Faxon Firearms, LLC, Cincinnati, OH (US)

(72) Inventor: Robert T. Faxon, Cincinnati, OH (US)

(73) Assignee: Faxon Firearms, LLC, Cincinnati, OH (US)

( * ) Notice: Subject to any disclaimer, the term of this patent is extended or adjusted under 35 U.S.C. 154(b) by 0 days.

(21) Appl. No.: 14/840,805

(22) Filed: Aug. 31, 2015

(65) Prior Publication Data

US 2016/0076842 A1 Mar. 17, 2016

Related U.S. Application Data

(60) Provisional application No. 62/049,436, filed on Sep. 12, 2014.

(51) Int. Cl.
*F41A 17/22* (2006.01)

(52) U.S. Cl.
CPC ..... *F41A 17/22* (2013.01)

(58) Field of Classification Search
CPC ..... F41A 17/22; F41A 17/20; F41A 17/28
USPC ..... 42/70.04–70.06
See application file for complete search history.

(56) References Cited

U.S. PATENT DOCUMENTS 678,420 A * 7/1901 Neuber et al. ..... F41A 17/46 42/70.06
1,085,698 A 2/1914 Nelson
1,249,576 A 12/1917 Wesson
1,732,115 A * 10/1929 Young ..... F41A 17/20 42/69.03
1,835,715 A 12/1931 McCoy
2,335,669 A 11/1943 Hanson
2,775,051 A 12/1956 Gehman
2,967,367 A 1/1961 Ivy
2,978,826 A 4/1961 Ivy
3,605,312 A 9/1971 Domian
4,162,586 A 7/1979 Pachmayr
4,335,643 A * 6/1982 Gal ..... F41A 3/54 42/25
4,677,781 A 7/1987 Lee
5,992,075 A 11/1999 Ockenfuss et al.
6,237,271 B1 * 5/2001 Kaminski ..... F41A 17/063 42/70.01
6,442,880 B1 * 9/2002 Allan ..... F41A 17/066 42/66
8,037,632 B2 * 10/2011 Pikielny ..... F41A 17/066 42/70.06
2001/0016999 A1 * 8/2001 Williams ..... F41A 17/74 42/70.08

(Continued)

FOREIGN PATENT DOCUMENTS

DE 102005006211 A1 8/2006
EP 0855569 B1 6/2003

*Primary Examiner* — Joshua Freeman
(74) *Attorney, Agent, or Firm* — Wood Herron & Evans LLP

(57) ABSTRACT

A passive safety for an AR platform firearm includes a sliding or pivoting rotating safety which is normally active to prevent trigger movement as would cause the firearm to discharge, and even when any active safety on the firearm is in a "fire" position. The passive safety is deactivated when an operator grips the firearm in a normal position to engage and pivot the trigger to discharge the firearm. Alternative embodiments are disclosed.

5 Claims, 7 Drawing Sheets

(56) References Cited

U.S. PATENT DOCUMENTS

| | | | | |
|---|---|---|---|---|
| 2002/0088159 | A1* | 7/2002 | McMoore | F41A 17/20 42/70.08 |
| 2007/0051236 | A1 | 3/2007 | Groves et al. | |
| 2008/0222935 | A1* | 9/2008 | Christiansen | F41A 17/22 42/70.06 |
| 2011/0107638 | A1* | 5/2011 | Emde | F41A 17/22 42/6 |
| 2011/0167698 | A1* | 7/2011 | Hoguc | F41C 23/10 42/71.02 |
| 2013/0019510 | A1* | 1/2013 | Kemmerer | F41A 17/20 42/1.01 |
| 2014/0305017 | A1* | 10/2014 | Travis | F41A 17/063 42/70.06 |
| 2014/0366419 | A1* | 12/2014 | Allan | F41A 17/06 42/70.06 |
| 2015/0247692 | A1* | 9/2015 | Harvey | F41A 17/00 42/70.11 |
| 2016/0084601 | A1* | 3/2016 | Alicea, Jr. | F41A 17/20 42/6 |

* cited by examiner

FIREARM GRIP SAFETY

RELATED APPLICATION

Applicant claims the benefit of the filing date of Sep. 12, 2014 U.S. Provisional Patent Application Ser. No. 62/049,436 which application is expressly incorporated herein as if fully set forth below.

FIELD OF INVENTION

This invention relates to a grip-mounted safety device for a firearm. More particularly, it relates to a passively deactivated safety device integrated into the grip of a firearm so as to allow it to fire only when the trigger is pulled while the user is maintaining a proper grip. More specifically, one preferred embodiment of this invention contemplates a grip safety particularly usefully embodied in an "AR" platform firearm.

BACKGROUND OF THE INVENTION

A wide variety of safety devices have been used in firearm designs in order to reduce the chance of an unintended discharge. Some safeties are internal and prevent discharge if, for example, the firearm is dropped. Other safeties are external and may be "passive" or "active." An active safety requires the user to perform a specific operation to disengage the safety, such as sliding a member, moving a lever, or rotating a selector switch. Passive external safeties include devices on the trigger or grip which are automatically deactivated when the firearm is properly held and the trigger is intentionally pulled. Some firearms include a combination of more than one internal, external, passive, or active safety devices.

A grip safety is a lever or other member situated on the grip of a firearm which must be displaced by the operator's hand, as a natural consequence of holding the firearm in a firing position, in order for the firearm to fire. The function of a grip safety is momentary in that the safety is deactivated only while the shooter maintains a proper hold on the grip and is reactivated automatically preventing discharge when the shooter releases it. The safety thus prevents discharge of the firearm in the absence of a proper, safety disengaging, grip.

A "single action" firing mechanism is one in which the hammer or striker is fully cocked and only a pull of trigger is necessary to cause it to discharge. Single action firearms are more likely to use an external manual safety to prevent accidental discharge. Some single action firearms, such as the M1911 pistol, also include a grip safety for added protection. A typical AR platform firearm, such as an AR15-style firearm, including the M16, M4, pistol configurations, and (other variants), has a single action type firing mechanism and employs only an active, external safety that is manually manipulated between "safe" and "fire" positions. If the manual safety is actively deactivated (selector switch set to "fire"), a loaded AR15-type firearm will discharge if the trigger is actuated, even if the operator is not properly gripping the firearm in a shooting position.

The use of passive safeties may have traditionally been considered less important on a rifle than on a pistol because rifles are not usually placed in a holster, a pocket, or a bag, the act of which can result in a foreign object engaging and actuating the trigger. In tactical situations, however, an operator may be more likely to quickly transition between use of a rifle and handgun and/or to allow the rifle to hang from a one or two point sling while performing some other close quarters task, such as reaching for other equipment or handcuffing a prisoner. If a chamber-loaded AR15-type rifle is allowed to hang from a sling with the manual active safety disengaged, it can and will discharge when any object presses the trigger, releasing the hammer. Unintentional discharge is an obviously serious consequence at any time and particularly when the firearm muzzle is not being safely controlled.

SUMMARY OF THE INVENTION

The present invention provides a grip safety, such as for an AR platform firearm including an AR15-type rifle, to prevent unintentional discharge unless it is being properly gripped by the operator.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various figures of the drawing, wherein.

DETAILED DESCRIPTION OF THE INVENTION

Figure 1:
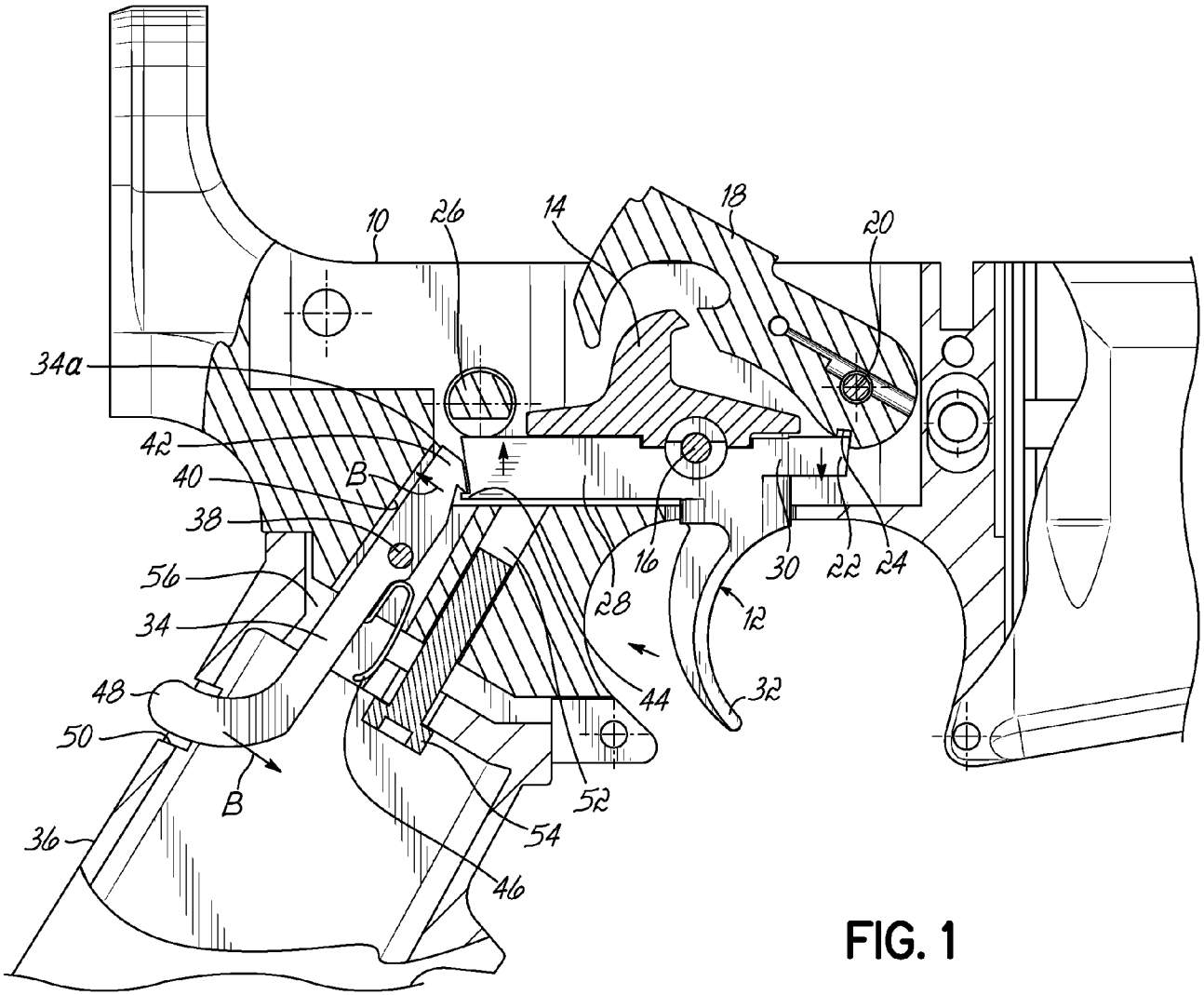
FIG. 1 is a partially cut-away illustrative side view of the right-hand side of a typical AR15-style lower receiver with an installed fire control group and a grip safety according to one embodiment of the present invention with the hammer engaged on a trigger sear surface.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

Referring first to FIG. 1, therein is shown at 10 a lower receiver for an otherwise typical AR15-type firearm. The receiver 10 includes a mechanism known collectively as the fire control group, which comprises a trigger 12 and disconnector 14 mounted to pivot in a limited range of motion on a trigger pin 16. A hammer 18 is pivotally mounted on a hammer pin 20 and is spring biased (not shown) toward the "dropped" position at which it will strike the firing pin (not shown), all as is well-known. The hammer 18 is held in a "cocked" position, as shown in FIG. 1, by engagement between the sear 22 and hammer notch 24. A selector 26 may be manually pivoted by the operator using an external lever on the opposite side of receiver 10 (not shown) to rotate it between "safe" and "fire" positions. When in the "safe" position, the selector 26 blocks upward movement of a rear extension portion 28 of the trigger 12.

A forward extension 30 of the trigger 12 carries the sear 22. A downward extension 32 of the trigger 12 acts as a lever or crank arm such that manipulation by the operator's finger causes the entire trigger 12 to pivot in a limited range of movement on the trigger pin 16. When the downward extension 32 is pulled rearwardly, the rear extension portion 28 is moved upward (as shown by arrows in FIG. 1) if not blocked by selector 26 or other safety disclosed herein. As a consequence of the same action, the forward extension 30 moves downward, causing the sear 22 to disengage from the hammer notch 24 and allowing the hammer 18 to be released and swung by spring force into contact with the firing pin. Each of these extensions 28, 30, 32 of the trigger 12 mechanically act in the form of a simple "bell crank," translating motion of one extension in a first direction into motion of another extension in a different direction. The heretofore described parts, mechanism and operation are standard to an ordinary AR15-type firearm.

Figure 3:
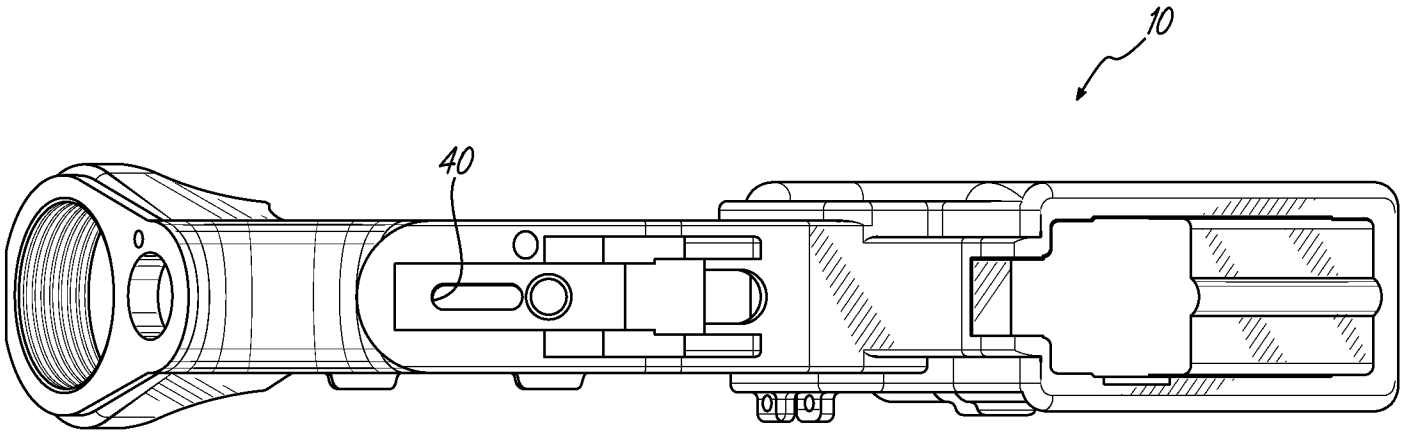
FIG. 3 is a bottom view of the lower receiver of FIG. 1 illustrating the slot in the receiver accommodating the safety lever.
Figure 4A:
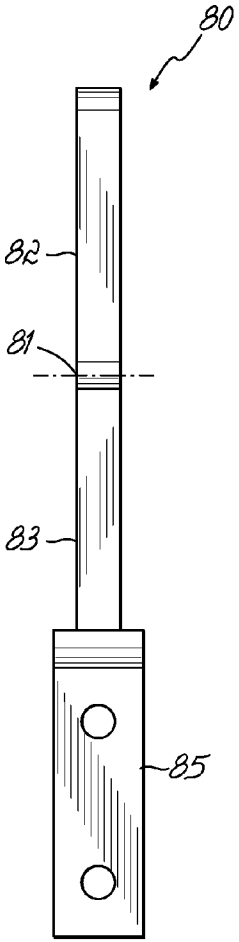
FIG. 4A is a rear view of the lever of FIG. 4.
Figure 4:
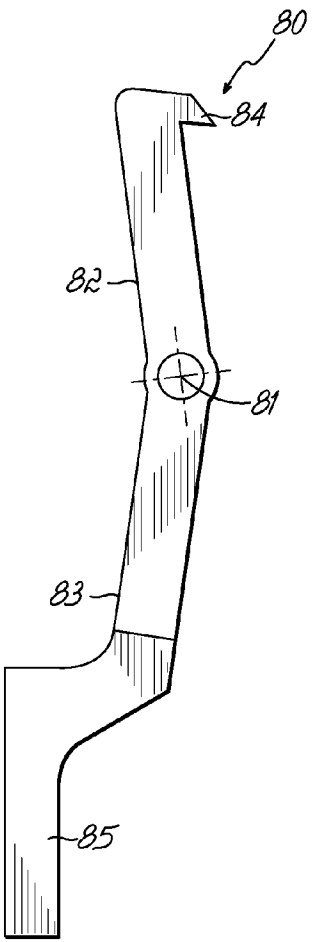
FIG. 4 is a side view of one modified embodiment of the safety lever of FIG. 1.
Figure 5A:
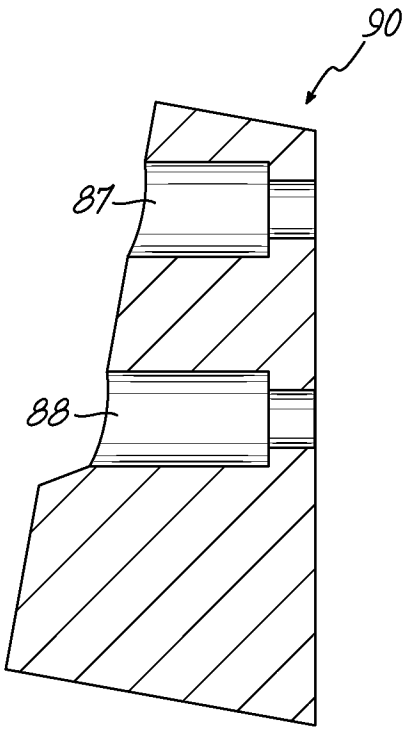
FIG. 5A is a section view of the projection of FIG. 5.
Figure 5:
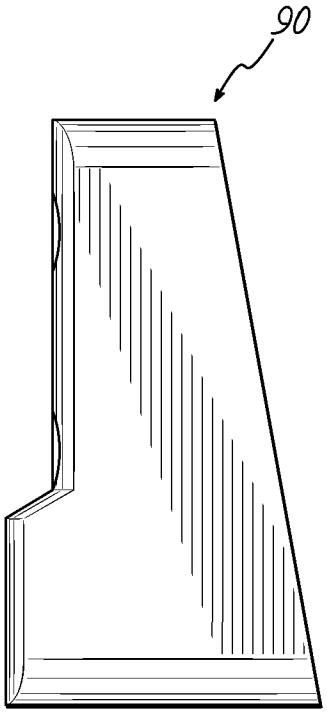
FIG. 5 is a side view of the operator engagement projection for the lower end of the modified lever of FIG. 4.

The present invention provides a grip safety lever 34 that is pivotally mounted relative to the receiver 10 and/or its pistol grip 36. Grip 36 has a rear edge as shown, the grip safety lever 34 is mounted on a pivot pin 38, which is carried by the lower receiver 10. An upper portion 34*a* of the grip safety member 34 extends through a channel 40 (FIG. 3) formed in the lower receiver 10 and includes a hook 42 that is positioned to engage a safety notch or stop 44 formed at or near the rear end or face of the rear extension 28 of the trigger 12 (see FIG. 6 for an enlarged view of notch 44). The grip safety 34 is spring biased into this engagement position by a spring means, such as a leaf spring 46 (shown in FIG. 1) or some other suitable torsion or coil spring. The grip safety 34 further includes a lower portion 48 that may extend rearwardly from the pistol grip 36 and is exposed for manual engagement through an opening 50 along an upper rear edge of the pistol grip 36 as shown.

In use, when an operator of the firearm grasps the pistol grip 36 in a manner that allows the trigger finger to reach and actuate the downward extension 32 of the trigger 12, that grasp will depress the lower portion 48 of the grip safety lever 34, usually by the palm of the hand or by the web of the hand between index finger and thumb, causing the lever 34 to rotate about the pivot pin 38 (as shown by arrows B in FIG. 1). This pivotal movement causes the hook portion 42 at the upper end of the grip safety lever 34 to be moved away from engagement with the notch 44 on the rear extension 28 of the trigger 12, allowing the trigger 12 to pivot and release the hammer notch 24 and thus the hammer 18. When an operator is not grasping the pistol grip 36, the hook 42 of the grip safety lever 34 remains engaged with the notch 44 of the rear extension 28 of the trigger 12, preventing its movement (and release of hammer 18) even if the selector 26 is set to "fire" (as shown in FIG. 1) and pressure is applied to trigger 12 either manually or by another agent.

Minimal alteration or modification of the standard design for an AR15-type lower receiver 10 or pistol grip 36 is required for adaptation to the grip safety of the present invention. As described above, a channel 40 (FIG. 3) is provided in the lower receiver 10. This channel can be behind and generally parallel to the attachment socket 52 that engages a threaded fastener 54 for attachment of the pistol grip 36 to the lower receiver body 10. As previously noted, the rear extension 28 of the trigger 12 is provided with a notch 44 for engagement of the hook 42. The pistol grip 36 is provided with an upper opening or channel 56 and the rear edge opening 50 to receive and expose the lower portion 48 of the grip safety 34.

Figure 6:
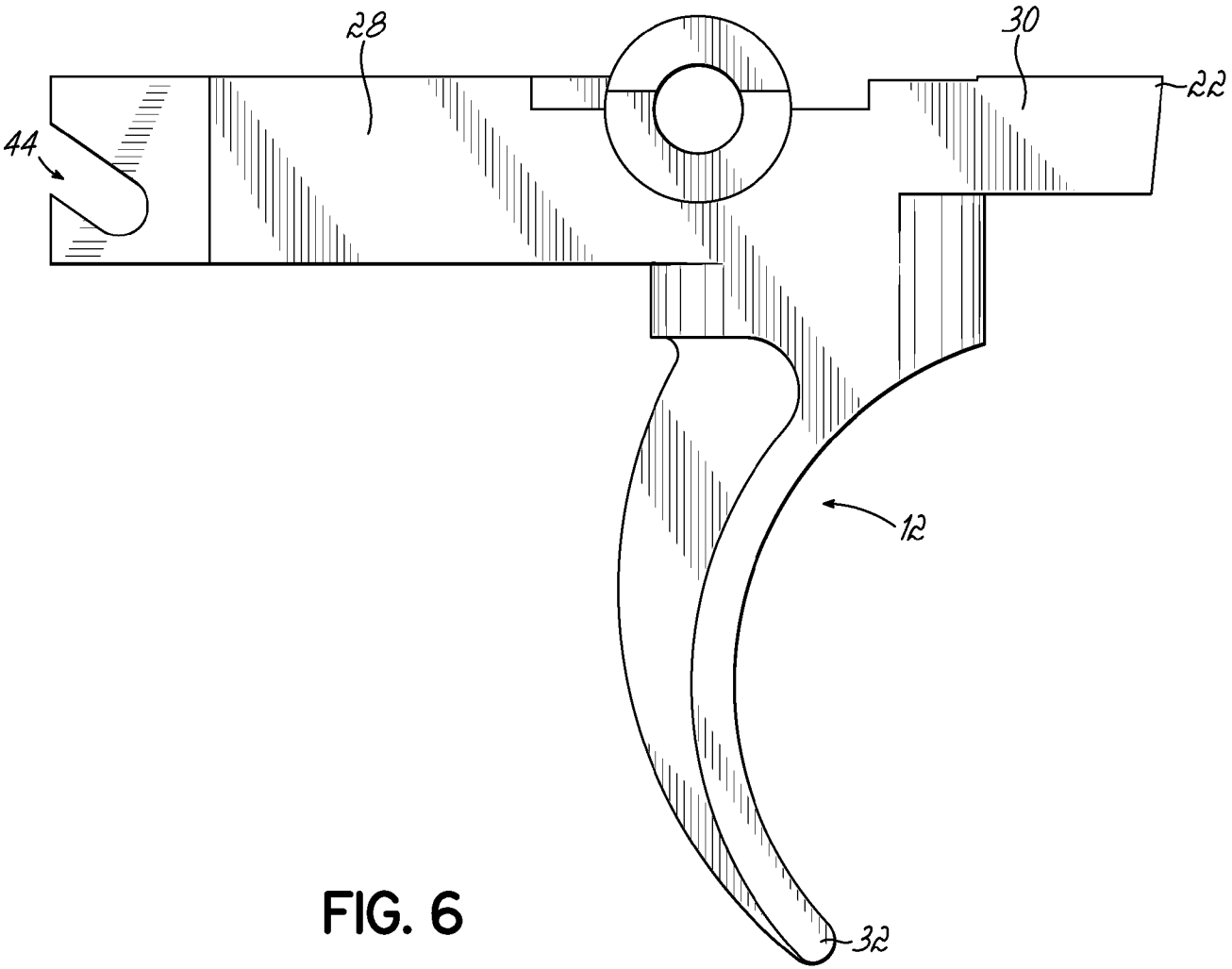
FIG. 6 illustrates an enlarged trigger embodiment illustrating the safety notch in the rear extension thereof.
Figure 7:
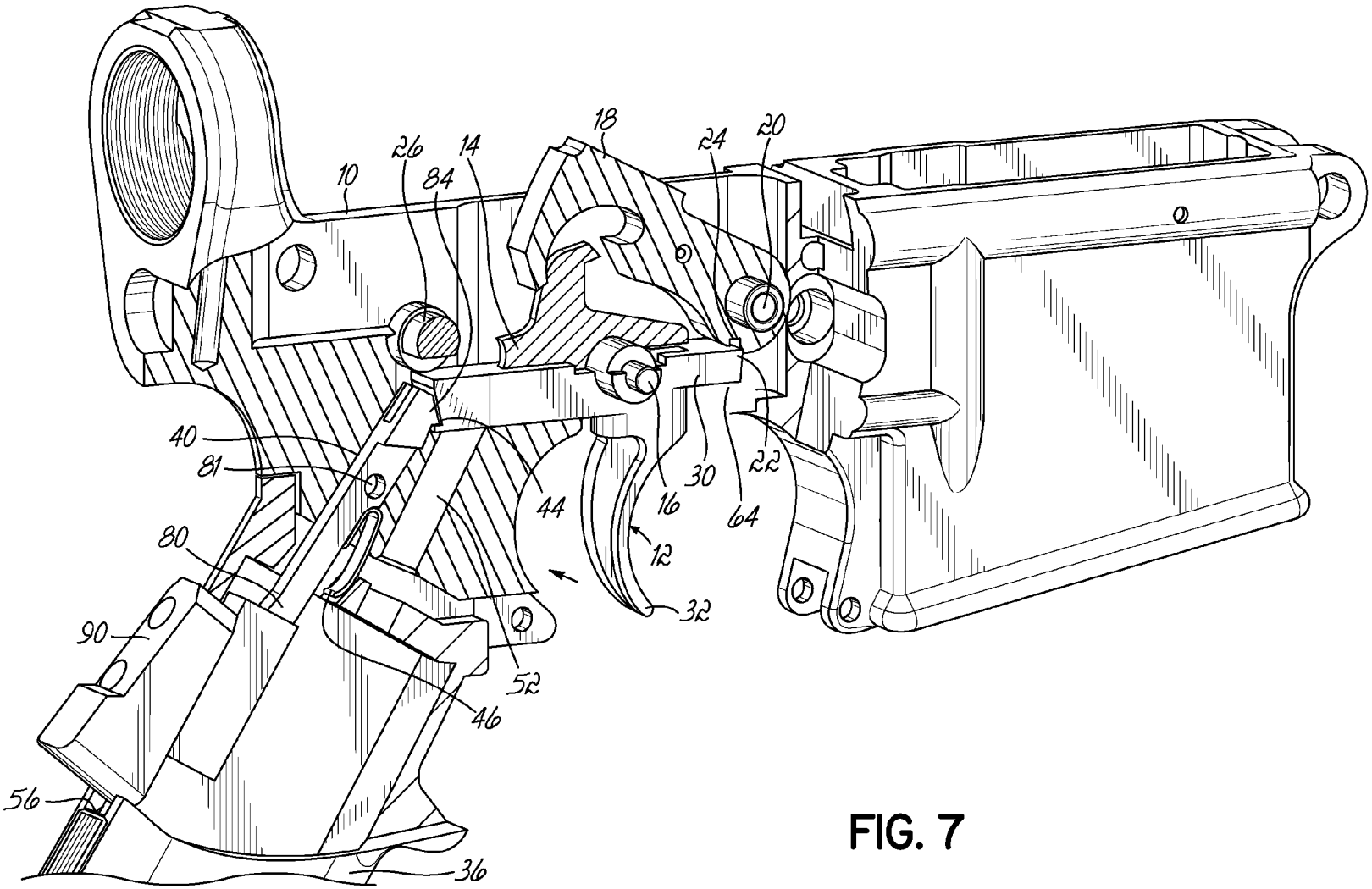
FIG. 7 is a partially cut-away isometric view showing the elements of FIGS. 4, 4A, 5, 5A, and 6 installed in a lower receiver and pistol grip.

Referring to FIGS. 4, 4A, 5 and 5A, there is shown a modified embodiment of the safety lever of FIG. 1. Safety lever 80 is like that of 34, excepting its overall shape as shown, formed to pivot about 81 on a pin such as at 38 (FIG. 1) with upper and lower portions 82, 83. Portion 82 includes hook 84 with similar function of hook 43 and notch 44 of FIG. 1. Projection 90 is secured to lower portion 83 at end 85 by screws or other fasteners thru holes 87, 88. Projection 90 extends outwardly of grip 36 for operator engagement when properly gripping the firearm. FIG. 6 shows an embodiment of a trigger member 12 illustrating the safety notch 44 in the rear extension 28 thereof. FIG. 7 shows a partially cut-away view of the safety lever 80 of FIGS. 4 and 4A, projection 90 of FIGS. 5 and 5A, and trigger member 12 of FIG. 6 installed in a lower receiver 10 with a pistol grip 36 and spring 46 in the "safe" position.

Figure 2:
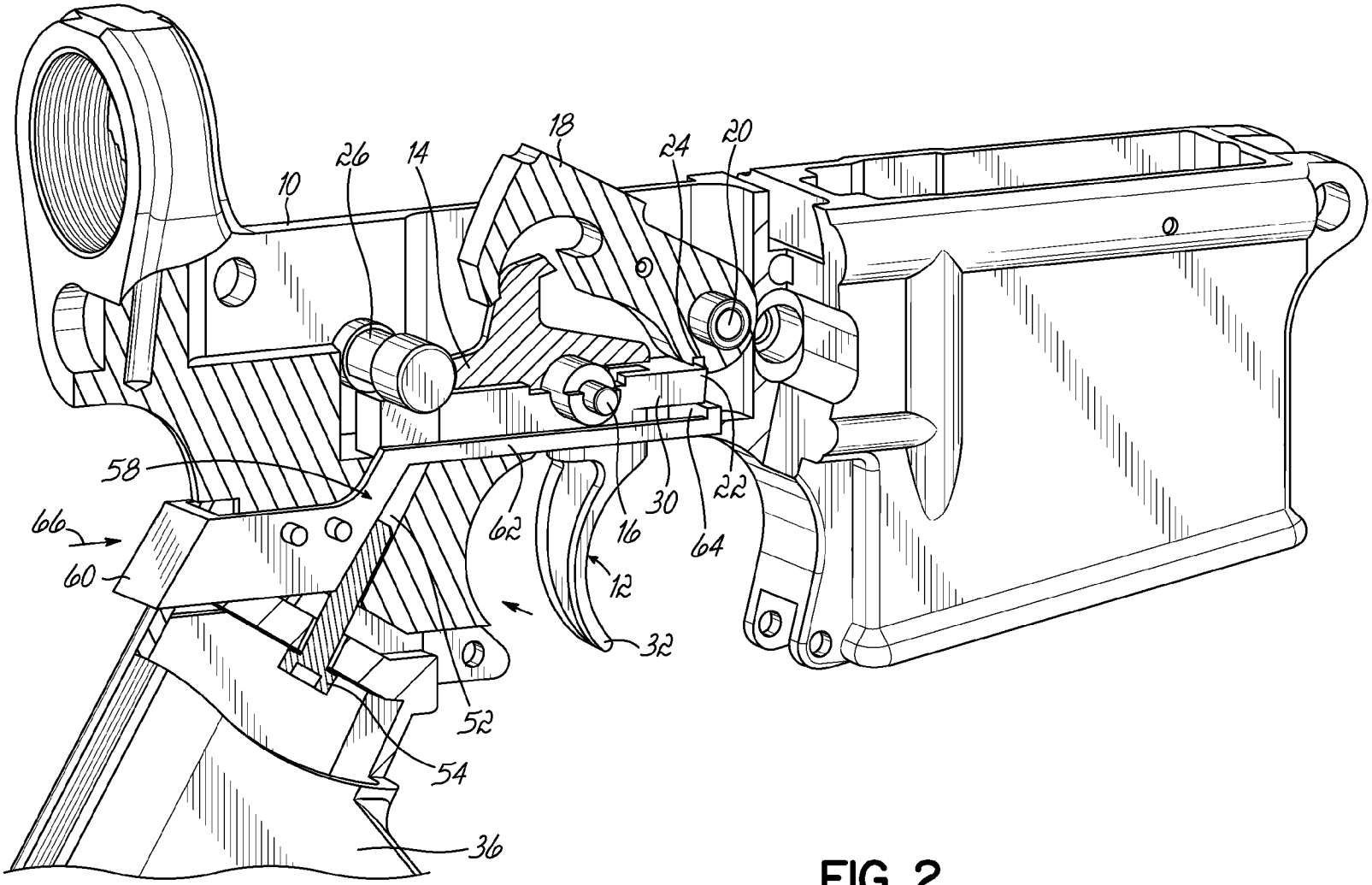
FIG. 2 is a partially cut-away isometric view (from a slightly rearward right-hand perspective) of a similar AR15-type lower receiver with a grip safety according to a second embodiment of the present invention.

Referring now to FIG. 2, therein is shown a firearm grip safety according to a second embodiment of the present invention. Like reference numerals will be used to indicate like parts that do not significantly differ from those shown and described with respect to the first embodiment, above. Different reference numerals will be used to identify parts that differ from those of the first embodiment.

The second embodiment provides a sliding, rather than pivoting, grip safety 58 having a rear portion 60 that is exposed along the upper back edge of the pistol grip 36 and/or lower receiver 10. It has a forwardly extending portion 62 with a transverse extension 64 at its forward end that underlies the forward extension 30 of the trigger 12 when the grip safety is in the "safe" position. In this position, the forward extension 30 of the trigger is blocked from downward movement, preventing the sear 22 from disengaging from the hammer notch 24 even if the downward extension 32 of the trigger 12 is pulled. The grip safety 58 is biased toward this position by a spring means (not shown), which can be a coil spring, leaf spring, or other suitable substitute.

When an operator grips the pistol grip 36 in a manner allowing the trigger finger to overlie and actuate the downward extension 32 of the trigger 12, the web of the operator's hand covers and depresses the rear exposed portion 60 of safety 58, causing the grip safety 58 to slide forward (as illustrated by arrow 66). When slid forward, the transverse extension 64 is moved forward of the forward extension 30 of the trigger 12, allowing the trigger 12 to pivot if actuated by the operator's trigger finger. However, once the operator releases his grip, the grip safety 58 is returned by spring force to its original rearward position (opposite arrow 66), causing the transverse extension 64 to underlie the forward extension 30 of the trigger 12, and preventing actuation of the trigger member 12 even if the manual safety selector 26 is in the "fire" position.

Accordingly, the present invention provides a passive safety that is disengaged by the operator's proper grip for firing and that is particularly adaptable to the AR15-type platform. If desired, a lock member (not shown) could be added to the pistol grip 36 or receiver 10 that could be actuated to selectively lock the grip safety lever 24, 80 in either the "safe" or "fire" position to override the passive nature of the device. A sliding member in the grip 36 could be positioned to engage the lower portion 48, 83 at or near the lower end 85 or to engage the projection 90 and hold the lever 24, 80 in either position. Alternatively, a movable member, such as but not limited to a sliding cross bolt member, could be positioned on or in a rear portion of the receiver 10 to engage and selectively hold the upper portion 34*a*, 82 of the safety lever 34, 80 in either position.

While specific embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention.

What is claimed is:

1. A firearm grip safety for a firearm, comprising:

a firearm receiver having a substantially downwardly extending pistol grip, the pistol grip having a rear edge;

a trigger mounted to pivot relative to the receiver and having a rearwardly extending portion that pivots upwardly in response to actuation of the trigger;

a grip safety member mounted to pivot relative to the receiver between a "safe" position and "fire" position, the member including a first portion that protrudes from the rear edge of the pistol grip and a second portion that is configured to selectively engage the rearwardly extending portion of the trigger member;

wherein the grip safety member is spring biased toward the "safe" position in which the second portion pivots into position to block upward movement of the rearwardly-extending portion of the trigger by its engagement therewith and is displaceable by a hand gripping the pistol grip for firing the firearm, such displacement moving the grip safety member to the "fire" position in which its second portion is pivoted away from engagement with the rearwardly extending portion of the trigger and does not block movement thereof.

2. The firearm grip safety of claim 1, further comprising a member that is selectively movable between positions that lock the grip safety member in the "safe" position or "fire" position.

3. The firearm grip safety of claim 1, wherein the firearm comprises an AR-15 platform lower receiver.

4. A grip safety for a firearm having a pistol grip, comprising:

a pivotable trigger having a manually engagable depending trigger with forward and rearward extending portions pivotable upon pivoting said trigger;

a sear on said forward extending portion for releasably engaging a hammer;

said rearward extending portion of said trigger including a safety stop;

said grip safety having a first end including a hook operatively engaging said safety stop and a second end having a portion protruding from said pistol grip;

said first end and hook being pivotable away from said rearward extending portion of said trigger when said second end of said safety is engaged for firing said firearm.

5. A grip safety as in claim 4, wherein said firearm includes a lower receiver and a slot in said firearm lower receiver, said grip safety disposed in said slot.

* * * * *